US007812790B2

(12) United States Patent
Kang et al.

(10) Patent No.: US 7,812,790 B2
(45) **Date of Patent: *Oct. 12, 2010**

(54) METHOD FOR DRIVING PLASMA DISPLAY PANEL

(75) Inventors: Seong Ho Kang, Daegu (KR); Sang Jin Yun, Pohang-shi (KR)

(73) Assignee: LG Electronics Inc., Seoul (KR)

( * ) Notice: Subject to any disclaimer, the term of this patent is extended or adjusted under 35 U.S.C. 154(b) by 947 days.

This patent is subject to a terminal disclaimer.

(21) Appl. No.: 11/638,585

(22) Filed: Dec. 14, 2006

(65) Prior Publication Data

US 2007/0091046 A1 Apr. 26, 2007

Related U.S. Application Data

(62) Division of application No. 10/630,720, filed on Jul. 31, 2003, now Pat. No. 7,187,346.

(30) Foreign Application Priority Data

Aug. 1, 2002 (KR) ..... 10-2002-45605

(51) Int. Cl.
*G09G 3/028* (2006.01)

(52) U.S. Cl. ..... 345/60; 345/692

(58) Field of Classification Search ..... 345/60–72, 345/204, 690–692
See application file for complete search history.

(56) References Cited

U.S. PATENT DOCUMENTS

| | | | | |
|---|---|---|---|---|
| 5,670,974 A | | 9/1997 | Ohba et al. | |
| 6,011,355 A | * | 1/2000 | Nagai | 315/169.3 |
| 6,144,163 A | * | 11/2000 | Amemiya et al. | 315/169.1 |
| 6,160,530 A | | 12/2000 | Makino | 345/60 |
| 6,188,374 B1 | | 2/2001 | Moon | |
| 6,295,040 B1 | | 9/2001 | Nhan et al. | |
| 6,337,673 B1 | | 1/2002 | Ide et al. | 345/60 |
| 6,483,491 B1 | | 11/2002 | Lee | |
| 6,603,447 B1 | | 8/2003 | Ito et al. | 345/60 |
| 6,621,230 B2 | | 9/2003 | Lim et al. | |
| 6,628,087 B2 | | 9/2003 | Roh et al. | 315/169.3 |
| 6,653,994 B2 | | 11/2003 | Takeda et al. | 345/60 |
| 6,653,995 B2 | | 11/2003 | Ho et al. | 345/60 |
| 6,760,000 B2 | | 7/2004 | Ide et al. | 345/66 |
| 6,784,859 B2 | | 8/2004 | Setoguchi et al. | 345/60 |

(Continued)

FOREIGN PATENT DOCUMENTS

| | | |
|---|---|---|
| JP | 2001-076631 | 3/2001 |

(Continued)

OTHER PUBLICATIONS

Office Action dated Oct. 26, 2009 for U.S. Appl. No. 11/641,873.

(Continued)

*Primary Examiner*—Stephen G Sherman
(74) *Attorney, Agent, or Firm*—KED & Associates, LLP

(57) ABSTRACT

A method of driving a plasma display panel that is adaptive for improving a picture quality. In the method, first and second sustain pulses having a different width during the sustain period are alternately applied to the first and second row electrodes.

31 Claims, 10 Drawing Sheets

U.S. PATENT DOCUMENTS

| | | | | |
|---|---|---|---|---|
| 7,006,057 | B2 | 2/2006 | Jin et al. | 345/60 |
| 2002/0008680 | A1 | 1/2002 | Hashimoto et al. | 345/63 |
| 2002/0021264 | A1 | 2/2002 | Nakamura | 345/60 |
| 2002/0105278 | A1 | 8/2002 | Kanazawa | |
| 2002/0135542 | A1 | 9/2002 | Kim et al. | 345/50 |
| 2003/0090441 | A1 | 5/2003 | Kim et al. | 345/60 |
| 2003/0117345 | A1 | 6/2003 | Yamamoto et al. | 345/60 |

FOREIGN PATENT DOCUMENTS

| | | |
|---|---|---|
| JP | 2001228820 | 8/2001 |
| KR | 20000073134 A | 5/2000 |

OTHER PUBLICATIONS

Office Action dated Apr. 22, 2010 for U.S. Appl. No. 11/641,873.

* cited by examiner

METHOD FOR DRIVING PLASMA DISPLAY PANEL

This application is a Divisional Application of U.S. patent application Ser. No. 10/630,720, filed Jul. 31, 2003 now U.S. Pat. No. 7,187,346, which claims the benefit of the Korean Patent Application No. 45605/2002 filed in Korea on Aug. 1, 2002, the subject matters of which are hereby incorporated by reference.

BACKGROUND OF THE INVENTION

1. Field of the Invention

This invention relates to a plasma display panel, and more particularly to a method of driving a plasma display panel that is adaptive for improving a picture quality.

2. Description of the Related Art

Generally, a plasma display panel (PDP) excites and radiates a phosphorus material using an ultraviolet ray generated upon discharge of an inactive mixture gas such as He+Xe, Ne+Xe or He+Ne+Xe, to thereby display a picture. Such a PDP is easy to be made into a thin-film and large-dimension type. Moreover, the PDP provides a very improved picture quality owing to a recent technical development.

FIG. 1 is a perspective view showing a structure of a conventional alternating current (AC) surface-discharge PDP.

Referring to FIG. 1, a discharge cell of the conventional three-electrode, AC surface-discharge PDP includes a scan electrode 12Y and a sustain electrode 12Z provided on an upper substrate 10, and an address electrode 20X provided on a lower substrate 18.

On the upper substrate 10 provided with the scan electrode 12Y and the sustain electrode 12Z in parallel, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with a phosphorous material 26. The address electrode 20X is formed in a direction crossing the scan electrode 12Y and the sustain electrode 12Z. The barrier rib 24 is formed in parallel to the address electrode 20X to thereby prevent an ultraviolet ray and a visible light generated by a discharge from being leaked to the adjacent discharge cells. The phosphorous material 26 is excited by an ultraviolet ray generated during the plasma discharge to generate any one of red, green and blue visible light rays. An inactive gas for a gas discharge is injected into a discharge space defined between the upper and lower substrate 10 and 18 and the barrier rib 24.

Referring to FIG. 2, the conventional AC surface-discharge PDP includes a PDP 30 arranged in a matrix type such that mxn discharge cells are connected to scan electrode lines Y1 to Ym, sustain electrode lines Z1 to Zm and address electrode lines X1 to Xn, a scan driver 32 for driving the scan electrode lines Y1 to Ym, a sustain driver 34 for driving the sustain electrode lines Z1 to Zm, and first and second address drivers 36A and 36B for making a divisional driving of odd-numbered address electrode lines X1, X3, . . . , Xn−3, Xn−1 and even-numbered address electrode lines X2, X4, . . . , Xn−2, Xn. The scan driver 32 sequentially applies a scan pulse and a sustain pulse to the scan electrode lines Y1 to Ym, to thereby sequentially scan discharge cells 1 for each line and sustain a discharge at each of the m×n discharge cells 1. The sustain driver 34 applies a sustain pulse to all the sustain electrode lines Z1 to Zm. The first and second address drivers 36A and 36M apply image data to the address electrode lines X1 to Xn in such a manner to be synchronized with a scan pulse. The first address driver 36A applies image data to the odd-numbered address electrode lines X1, X3, . . . , Xn−3, Xn−1 while applying image data to the even-numbered address electrode lines X2, X4, . . . , Xn−2, Xn.

The AC surface-discharge PDP driven as mentioned above requires a high voltage more than hundreds of volts for an address discharge and a sustain discharge. Accordingly, in order to minimize a driving power required for the address discharge and the sustain discharge, the scan driver 32 and the sustain driver is additionally provided with an energy recovering apparatus 38 as shown in FIG. 3. The energy recovering apparatus 38 recovers a voltage charged in the scan electrode line Y and the sustain electrode line Z and re-uses the recovered voltage as a driving voltage for the next discharge.

Such a conventional driving apparatus 38 includes an inductor L connected between a panel capacitor Cp and a source capacitor Cs, and first and third switches S1 and S3 connected, in parallel, between the source capacitor Cs and the inductor L. A scan/sustain driver 32 is comprised of second and fourth switches S2 and S4 connected, in parallel, between the panel capacitor Cp and the inductor L. The panel capacitor Cp is an equivalent expression of a capacitance formed between the scan electrode line Y and the sustain electrode line Z. The second switch S2 is connected to a sustain voltage source Vsus while the fourth switch S4 is connected to a ground voltage source GND. The source capacitor Cs recovers and charges a voltage charged in the panel capacitor Cp upon sustain discharge and re-supply the charged voltage to the panel capacitor Cp. The source capacitor Cs has a large capacitance value such that it can charge a voltage Vsus/2 equal to a half value of the sustain voltage Vsus. The first to fourth switches S1 to S4 controls a flow of current. The energy recovering apparatus 38 provided at the sustain driver 34 are formed around the panel capacitor Cp symmetrically with the scan driver 32.

FIG. 4 is a timing diagram and a waveform diagram representing on/off timings of the switches shown in FIG. 3 and an output waveform of the panel capacitor.

An operation procedure of the energy recovering apparatus 38 shown in FIG. 3 will be described in conjunction with FIG. 4.

First, it is assumed that a voltage charged between the scan electrode line Y and the sustain electrode line Z, that is, a voltage charged in the panel capacitor Cp prior to the T1 period should be 0 volt, and a voltage Vsus/2 has been charged in the source capacitor Cs.

In the T1 period, the first switch S1 is turned on, to thereby form a current path extending from the source capacitor Cs, via the first switch S1 and the inductor L, into the panel capacitor Cp. At this time, the inductor L and the panel capacitor L forms a serial resonance circuit. Since a voltage Vsus/2 has been charged in the source capacitor Cs, a voltage of the panel capacitor Cp rises into a sustain voltage Vsus equal to twice the voltage of the source capacitor Cs with the aid of a current charge/discharge of the inductor L in the serial resonance circuit.

In the T2 period, the second switch S2 is turned on to thereby apply the sustain voltage Vsus to the scan electrode line Y. The sustain voltage Vsus applied to the scan electrode line Y prevents a voltage of the panel capacitor Cp from falling into less than the sustain voltage Vsus to thereby cause a normal sustain discharge. Since a voltage of the panel capacitor Cp has risen into the sustain voltage Vsus in the T1 period, a driving power supplied from the exterior for the purposing of causing the sustain discharge is minimized.

In the T3 period, the first switch S1 is turned off and the panel capacitor Cp keeps the sustain voltage Vsus. In the T4 period, the second switch S2 is turned off while the third switch S3 is turned on. If the third switch S3 is turned on, then a current path extending from the panel capacitor Cp, via the inductor L and the third switch S3, into the source capacitor Cs is formed to thereby recover a voltage charged in the panel capacitor Cp into the source capacitor Cs. While the panel capacitor Cp is discharged, a voltage of the panel capacitor Cp falls. At the same time, a voltage Vsus/2 is charged in the source capacitor Cs. After a voltage Vsus/2 was charged in the source capacitor Cs, the third switch S3 is turned off while the fourth switch S4 is turned on. In the fifth period when the fourth switch S4 is turned on, a current path extending from the panel capacitor Cp into the ground voltage source GND, thereby allowing a voltage of the panel capacitor Cp to falls into 0 volt. In the T6 period, a state in the T5 period is kept for a certain time as it is. An AC driving pulse applied to the scan electrode line Y and the sustain electrode line Z is obtained by periodically repeating an operation procedure in the T1 to T6 periods.

The scan electrode lines Y of the PDP driven in this manner are supplied with a sustain pulse in the sustain period, and are additionally supplied with a reset pulse and a scan pulse in the initialization period and the address period, respectively. Accordingly, the scan driver 32 is provided with a plurality of scan drive integrated circuits and a plurality of high-voltage switches. On the other hand, since the sustain pulse only is supplied, the sustain electrode line Z is directly connected to the sustain driver 34. As a result, a resistance of the current path at the scan driver 32 and the scan electrode line Y becomes larger than that of the current path at the sustain driver 34 and the sustain electrode line Z. Further, the scan driver 32 has a smaller current supply capability than the sustain driver 34.

In spite of such a resistance different of the current path and such a difference in the current supply capability, pulse widths TP1 and TP2 of a first sustain pulse SUS1 and a second sustain pulse SUS2 applied to the scan electrode line Y and the sustain electrode line Z during the sustain period, respectively are equal to each other as shown in FIG. 5. In other words, a rising edge Tr1 of the first sustain pulse SUS1 is identical to a rising edge Tr2 of the second sustain pulse SUS2, and a falling edge Tf1 of the first sustain pulse SUS1 is identical to a falling edge of Tf2 of the second sustain pulse SUS2. Herein, the rising edges Tr1 and Tr2 of the first and second sustain pulses are time intervals going from an operation time of the energy recovering apparatus 38 shown in FIG. 3 until a turning-on time of the second switch S2 while the falling edges Tf1 and Tf2 thereof are time intervals going from an operation time of the energy recovering apparatus 38 into the fourth switch S4.

Accordingly, intensities of sustain discharges caused by the first and second sustain pulses SUS1 and SUS2 applied to the scan electrode line Y and the sustain electrode line Z, respectively are differentiated to raises problems of an irregular discharge and hence a deterioration of picture quality. Particularly, such problems become more serious when a width of each of the first and second sustain pulses SUS1 and SUS2 is approximately 2 μs as a resolution is larger.

SUMMARY OF THE INVENTION

Accordingly, it is an object of the present invention to provide a method of driving a plasma display panel that is adaptive for improving a picture quality.

In order to achieve these and other objects of the invention, a method of driving a plasma display panel according to an embodiment of the present invention, having first and second row electrodes and a heat electrode and including a sustain period for implementing a gray scale depending upon a discharge frequency, includes the step of alternately applying first and second sustain pulses having a different width during the sustain period to the first and second row electrodes.

In the method, a resistance going from a first driver generating the first sustain pulse into the first row electrode is different from a resistance going from a second driver generating the second sustain pulse into the second row electrode.

Herein, said resistance going from the first driver into the first row electrode is larger than a resistance going from the second driver into the second row electrode.

A width of the first sustain pulse is longer than that of the second sustain pulse.

A sustain period of the first sustain pulse is longer than that of the second sustain pulse.

A rising edge caused by an energy recovering circuit of the first sustain pulse is shorter than a rising edge caused by the energy recovering circuit of the second sustain pulse.

Alternatively, a resistance going from the second driver into the second row electrode is larger than a resistance going from the first driver into the first row electrode.

A width of the second sustain pulse is longer than that of the first sustain pulse.

A sustain period of the second sustain pulse is longer than that of the first sustain pulse.

A rising edge caused by an energy recovering circuit of the second sustain pulse is shorter than a rising edge caused by the energy recovering circuit of the first sustain pulse.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 6:
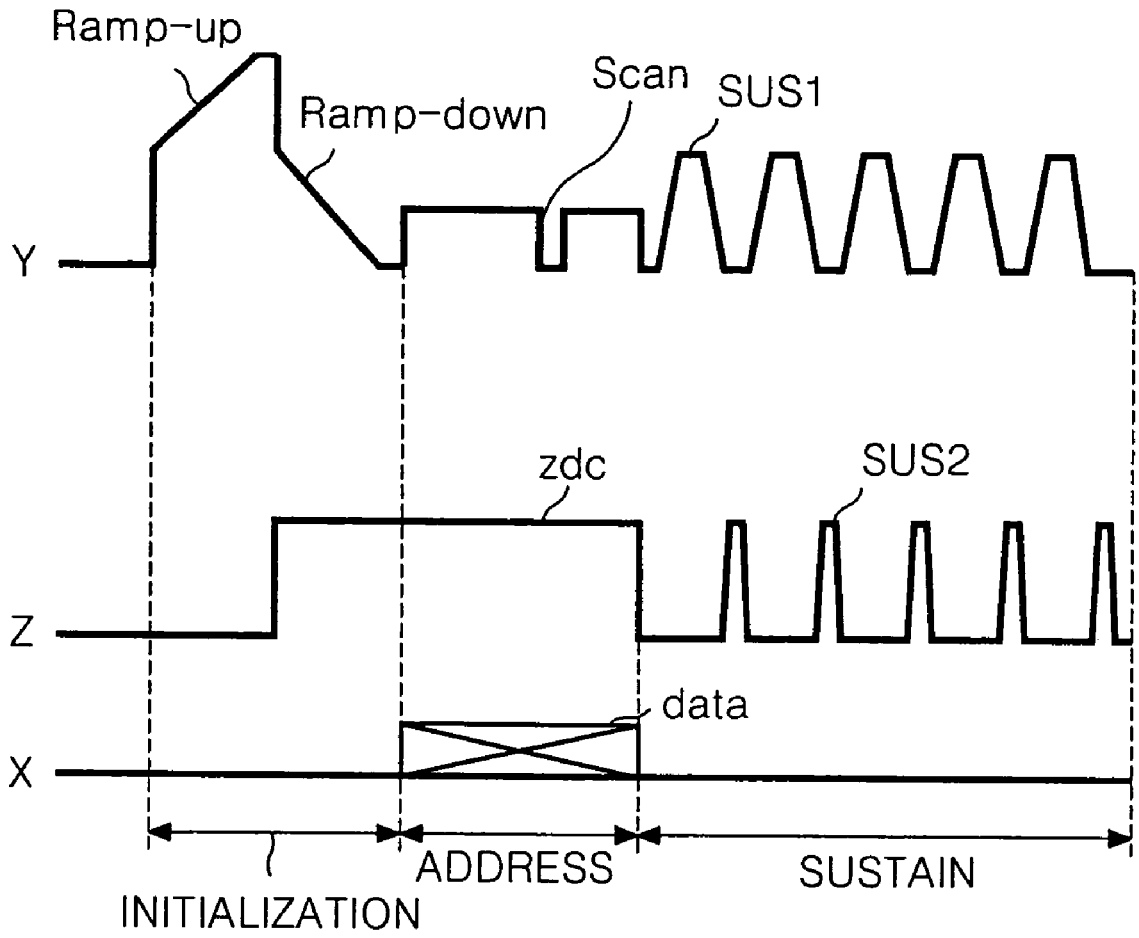
FIG. 6 is a waveform diagram for explaining a method of driving a plasma display panel according to an embodiment of the present invention.

FIG. 6 shows a method of driving a plasma display panel according to an embodiment of the present invention.

Referring to FIG. 6, each sub-field is divided into an initialization period for initializing cells of the entire field, and a sustain period for implementing a gray scale depending upon an address period for selecting a discharge cell and a discharge frequency.

In the initialization period, a rising ramp waveform Ramp-up generated at the scan driver is simultaneously applied to all the scan electrodes. The rising ramp waveform Ramp-up causes a weak discharge within cells of the entire field to thereby generate wall charges within the cells. After the rising ramp waveform Ramp-up was applied, a falling ramp waveform Ramp-down is simultaneously applied to the scan electrodes Y. The falling ramp waveform Ramp-down causes a weak erasure discharge with the cells, to thereby uniformly left wall charges required for the address discharge within the cells of the entire field.

In the address period, a negative scan pulse Scan is sequentially applied to the scan electrodes Y and, at the same time, a positive data pulse data is applied to the address electrodes X. An address discharge is generated within the cells to which the scan pulse Scan and the data pulse data are applied. Wall charges are generated within the cells selected by the address discharge. A positive direct current (DC) voltage zdc is applied to the sustain electrodes Z in the set-down period and the address period.

In the sustain period, the first and second sustain pulses SUS1 and SUS2 are alternately applied to the scan electrodes Y and the sustain electrodes Z. The cell selected by the address discharge causes a sustain discharge taking a surface-discharge type between the scan electrode Y and the sustain electrode Z whenever each of the sustain pulses SUS1 and SUS2 is applied while the wall charges within the cell being added to the sustain pulses SUS1 and SUS2.

Widths of the first and second sustain pulses SUS1 and SUS2 applied to the scan electrode Y and the sustain electrode Z, respectively are differentiated. This will be described in detail with reference to FIG. 7A to FIG. 8B.

Figure 7A:
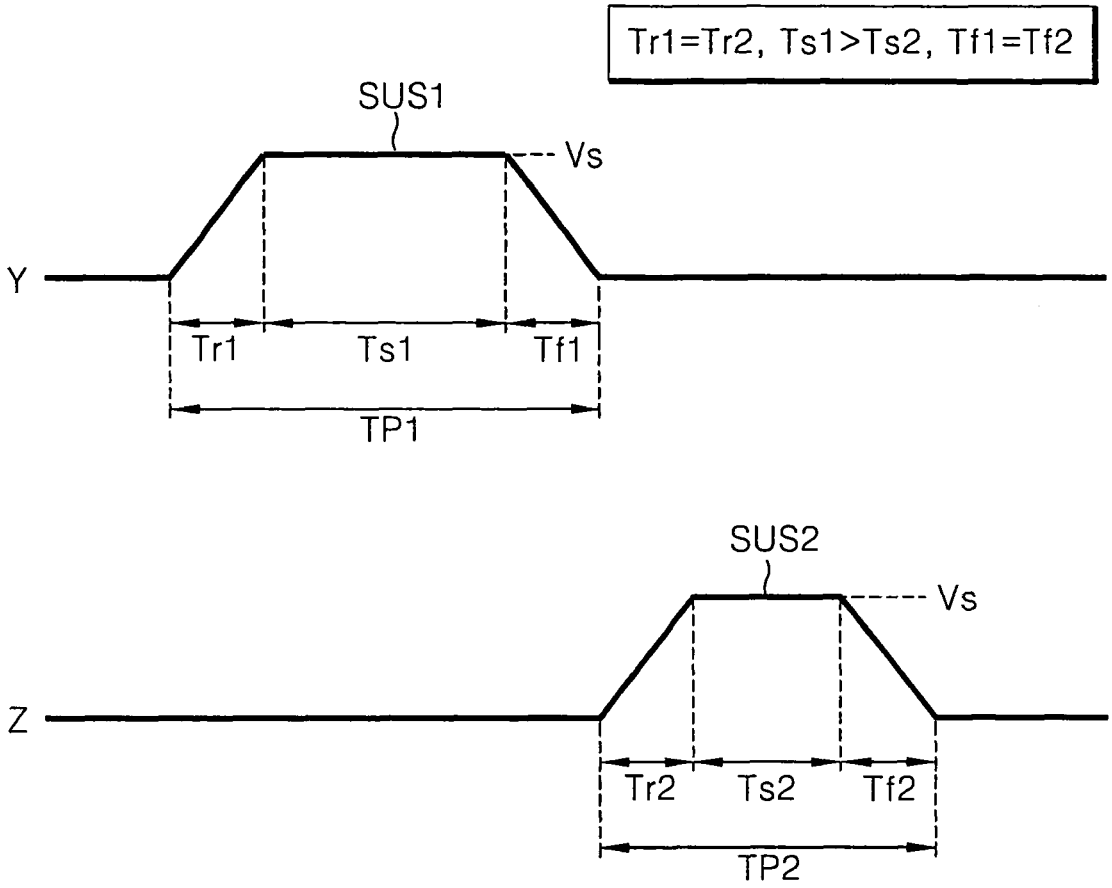
FIG. 7A and FIG. 7B are detailed waveform diagrams of the first and second sustain pulses in the sustain period shown in FIG. 6.
Figure 7B:
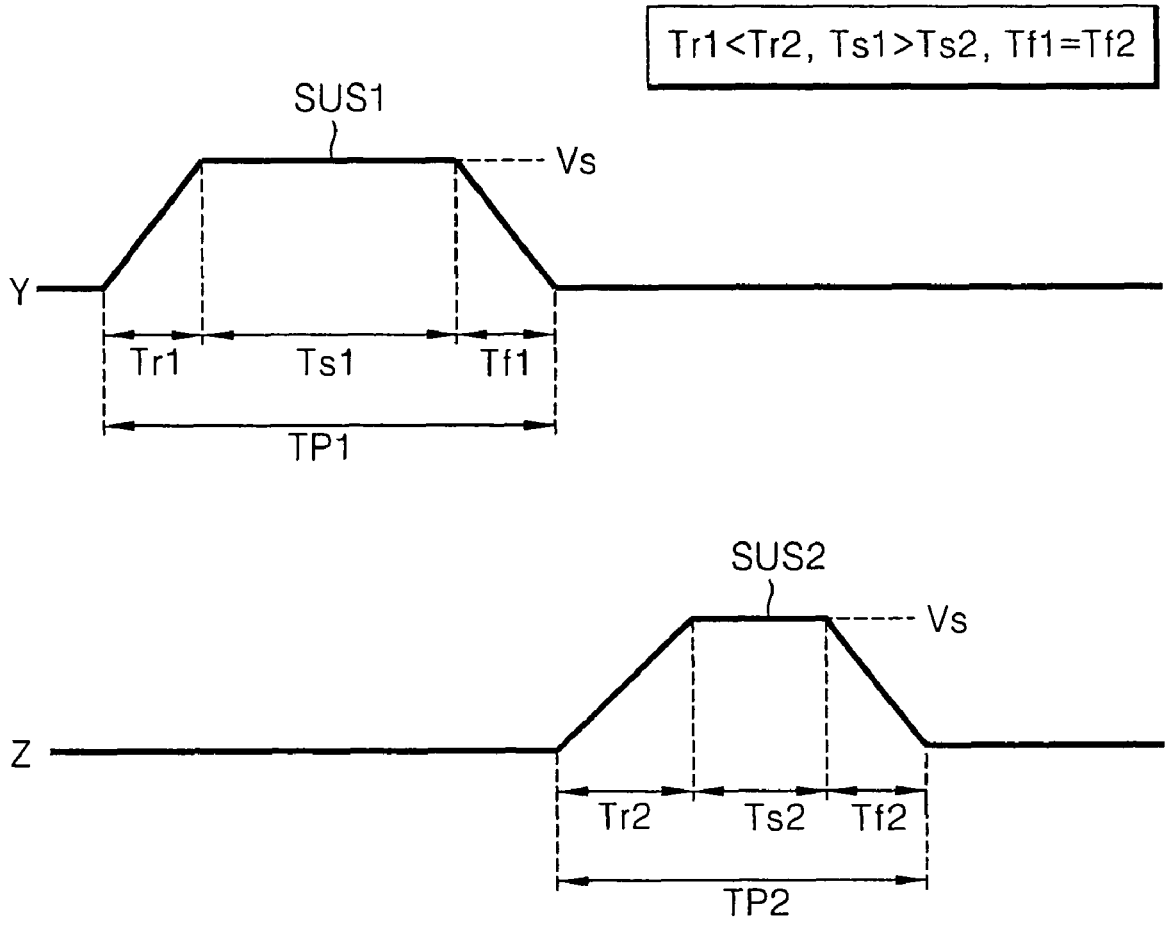

FIG. 7A and FIG. 7B show a sustain pulse applied when a resistance of the current path extending from the scan driver into the scan electrode line Y is smaller than that of the current path extending from the sustain driver into the sustain electrode line Z.

Figure 8A:
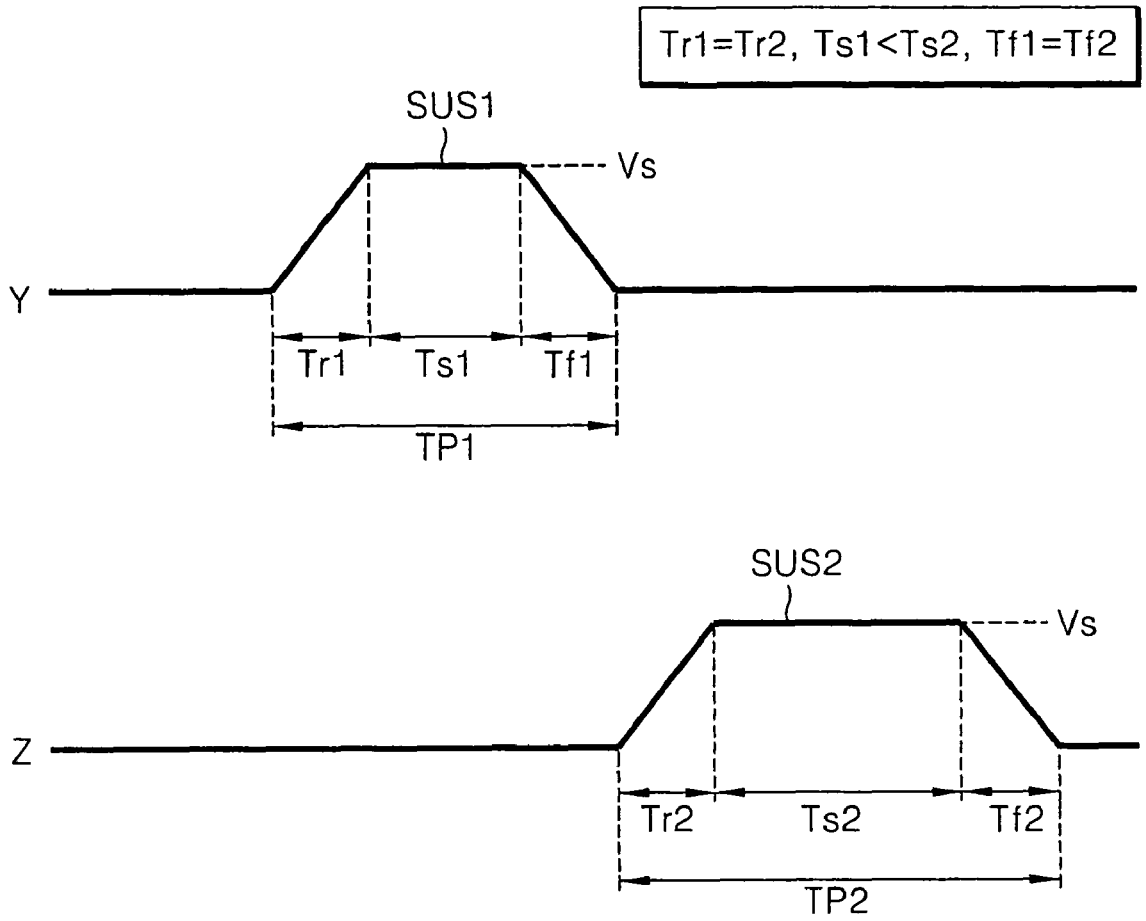
FIG. 8A and FIG. 8B are detailed waveform diagrams showing another shapes of the first and second sustain pulses in the sustain period shown in FIG. 6.
Figure 8B:
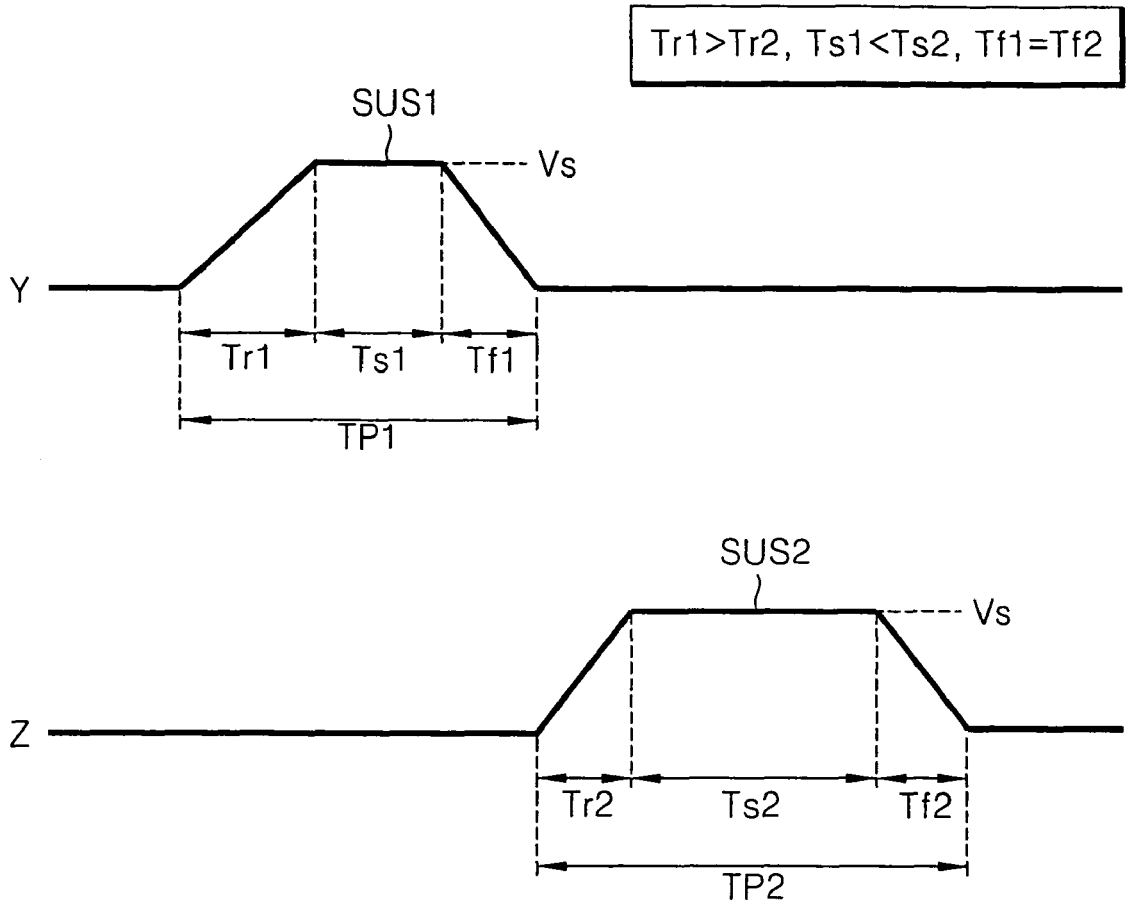

Referring to FIG. 8A and FIG. 8B, a width TP1 of the first sustain pulse SUS1 applied to the scan/sustain electrode line Y is smaller than a width TP2 of the second sustain pulse SUS2 applied to the sustain electrode line Z.

As shown in FIG. 8A, a rising edge Tr1 of the first sustain pulse SUS1 is identical to a rising edge Tr2 of the second sustain pulse SUS2; a sustain interval Ts1 of the first sustain pulse SUBS is shorter than a sustain interval Ts2 of the second sustain pulse SUS2; and a falling edge Tf1 of the first sustain pulse SUS1 is identical to a falling edge Tf2 of the second sustain pulse SUS2.

Figure 1:
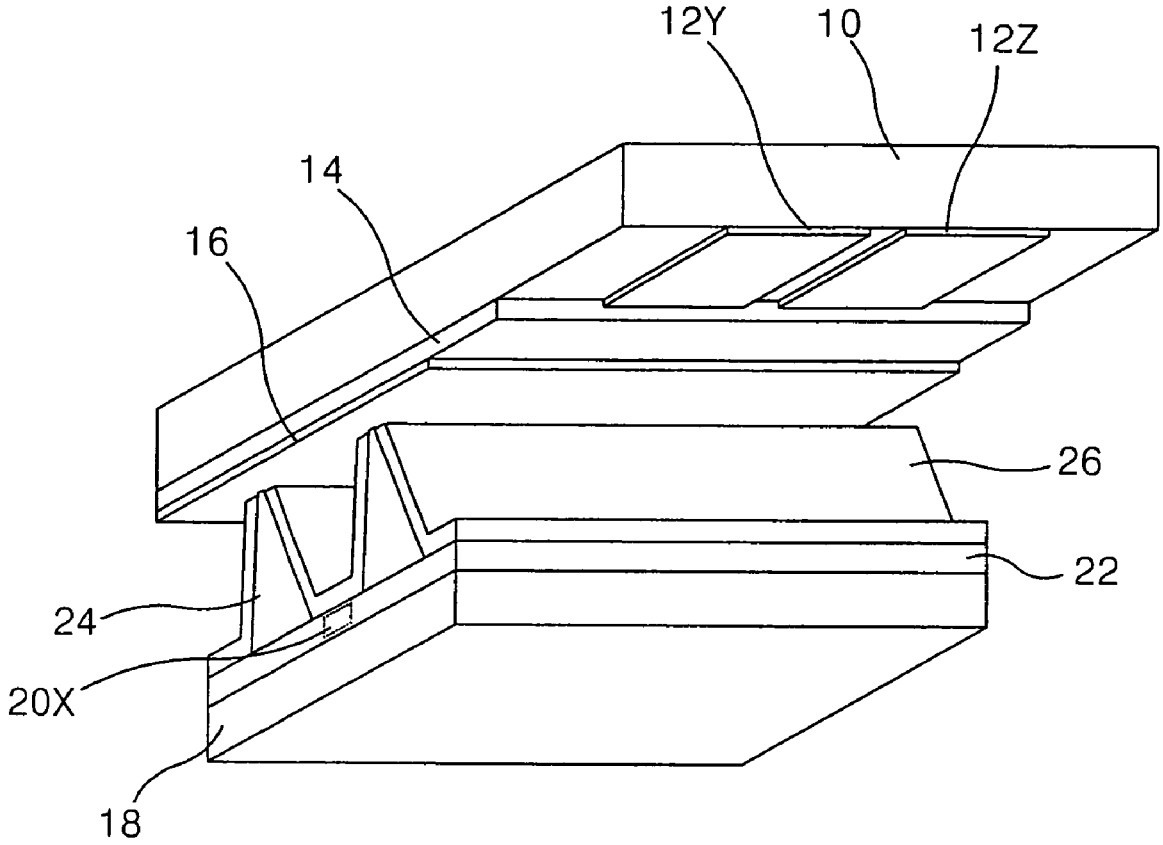
FIG. 1 RELATED ART
FIG. 1 is a perspective view representing a structure of a conventional AC surface-discharge plasma display panel.
Figure 2:
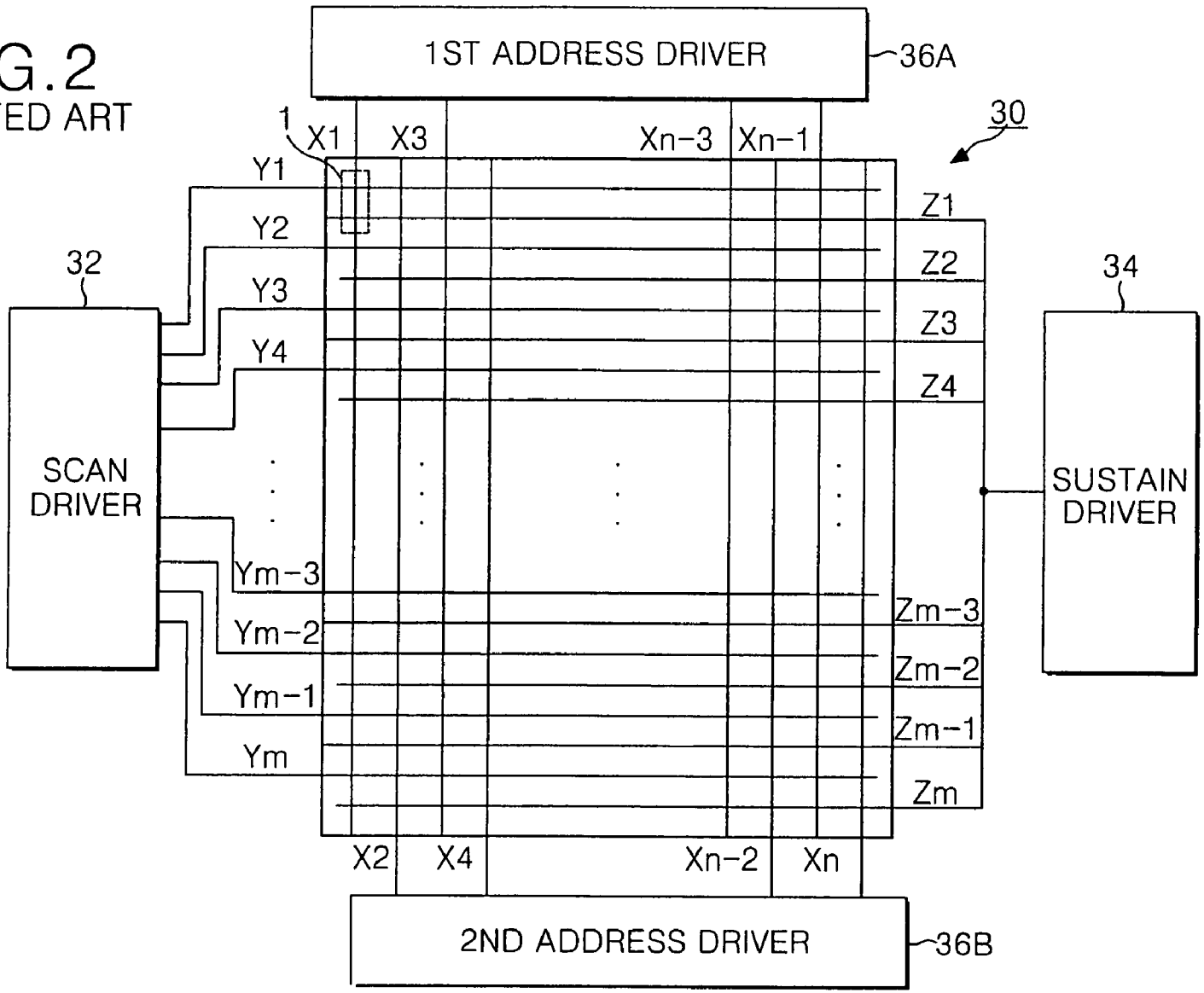
FIG.2 RELATED ART
FIG. 2 is a plan view showing an arrangement structure of overall electrode lines and discharge cells of the plasma display panel in FIG. 1.
Figure 3:
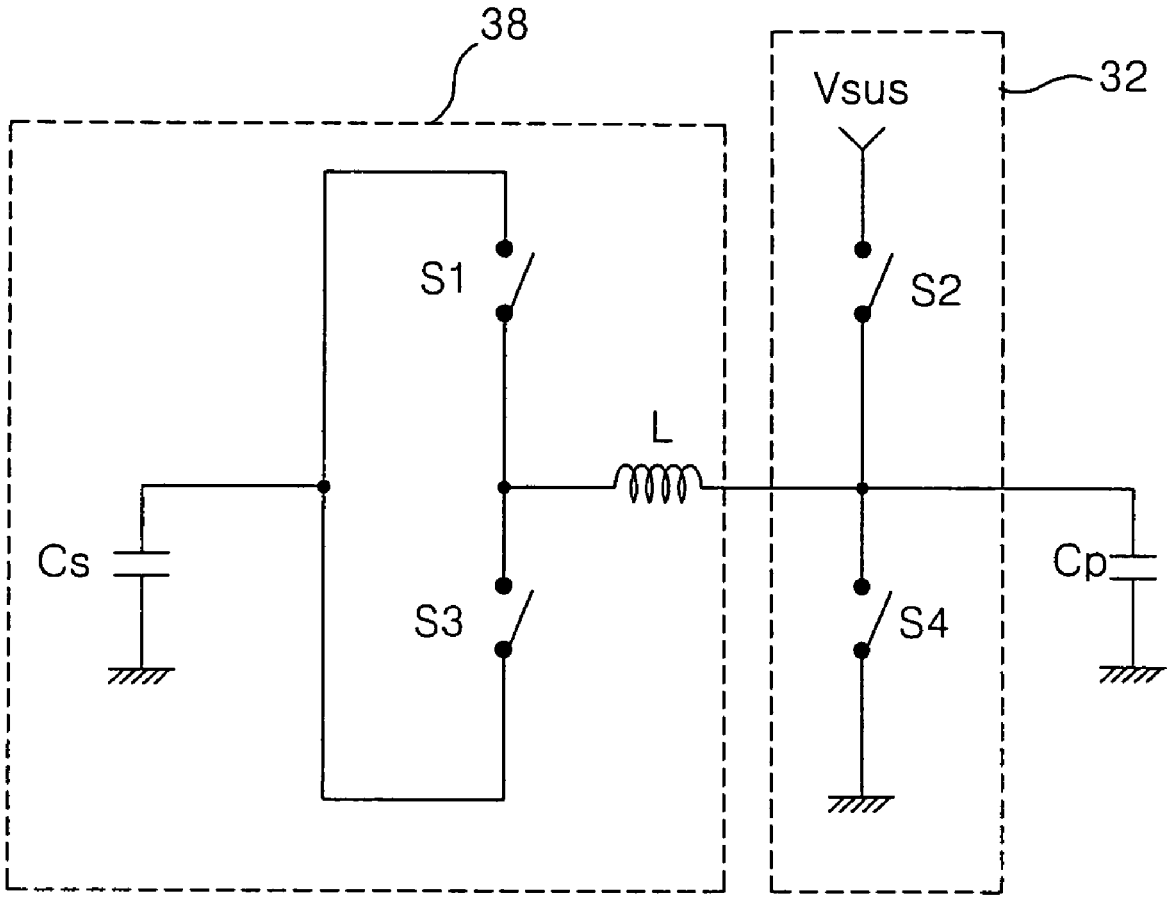
FIG. 3 RELATED ART
FIG. 3 is a circuit diagram of a conventional energy recovering apparatus provided at the pre-stage of the sustain driver in FIG. 2.
Figure 4:
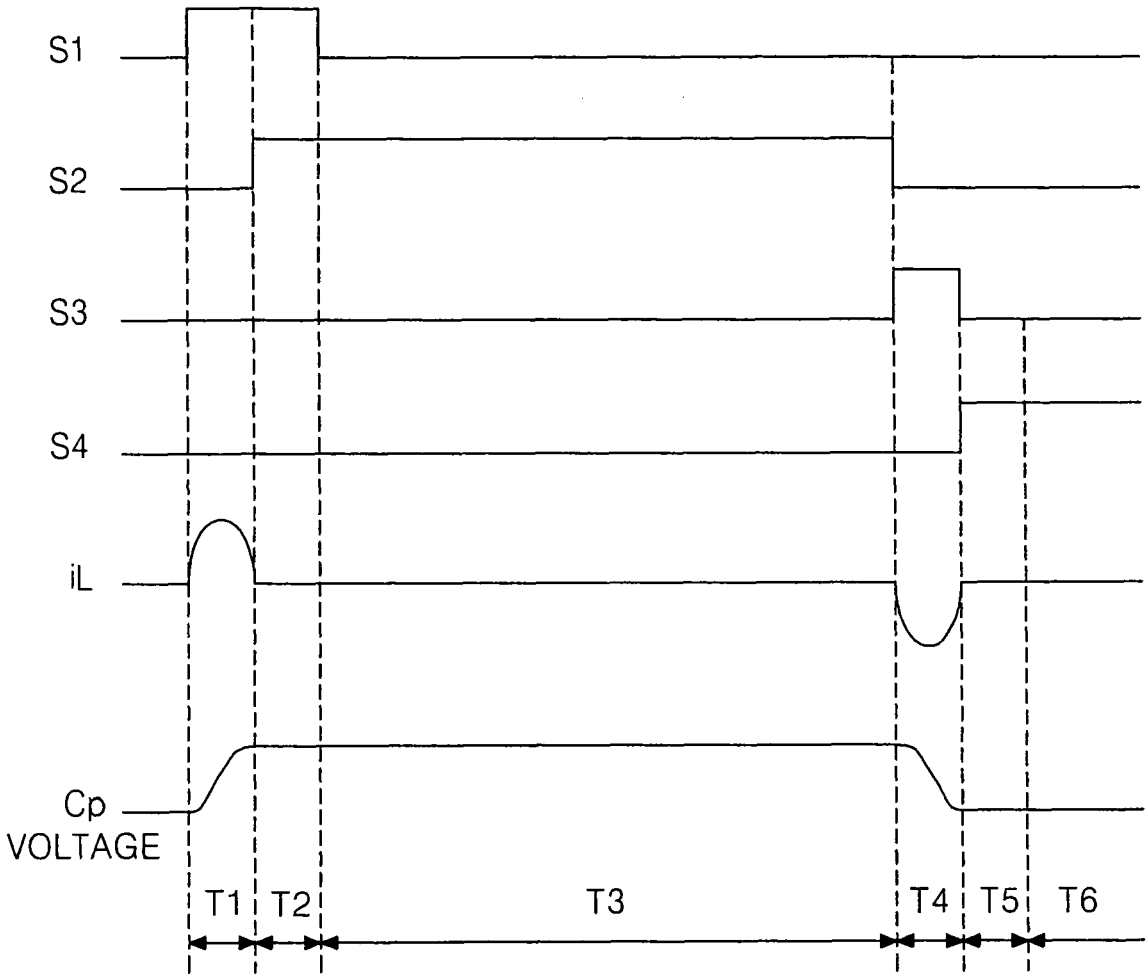
FIG. 4 RELATED ART
FIG. 4 is a timing diagram and a waveform diagram representing an ON/OFF timing of each switch shown in FIG. 2 and an output waveform of the panel capacitor.
Figure 5:
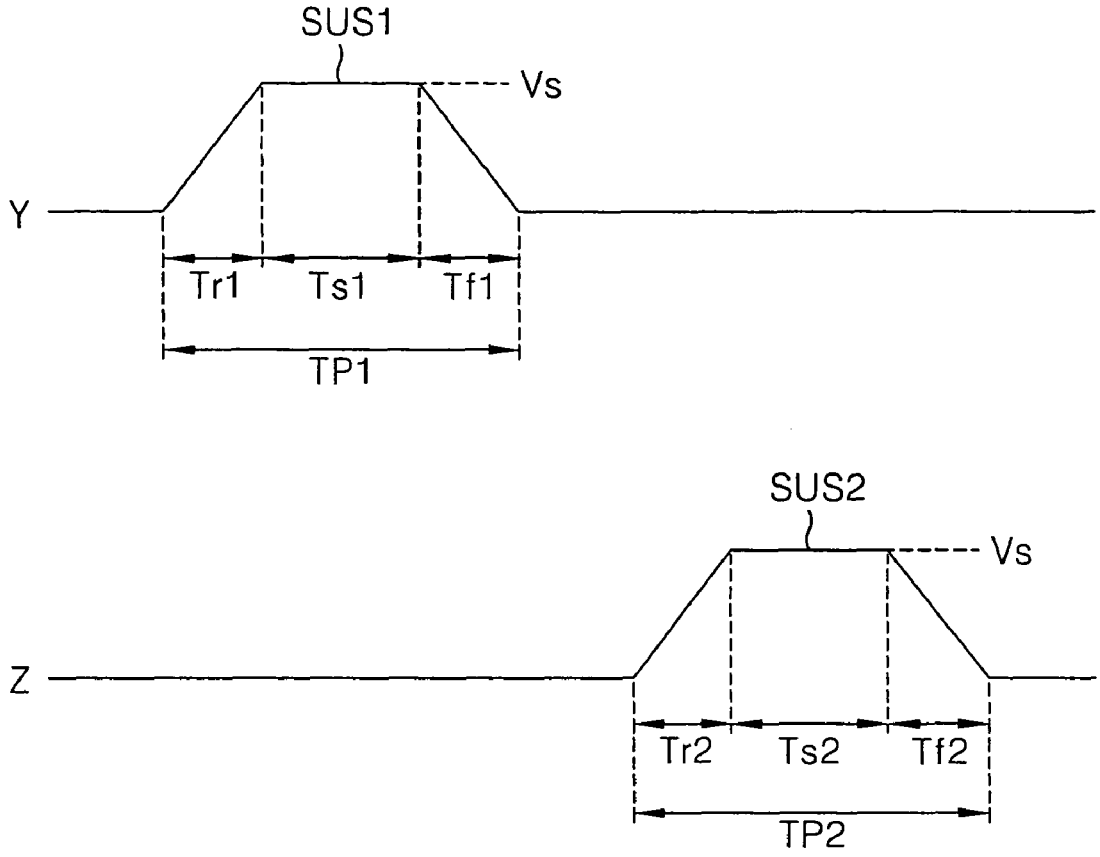
FIG. 5 RELATED ART
FIG. 5 is a detailed waveform diagram of a sustain pulse applied to the sustain electrode pair shown in FIG. 2.

As shown in FIG. 8B, a rising edge Tr1 of the first sustain pulse SUS1 is longer than a rising edge Tr2 of the second sustain pulse SUS2; a sustain interval Ts1 of the first sustain pulse SUS1 is shorter than a sustain interval Ts2 of the second sustain pulse SUS2; and a falling edge Tf1 of the first sustain pulse SUS1 is identical to a falling edge Tf2 of the second sustain pulse SUS2. As a rising edge of the sustain pulse is smaller, a discharge intensity becomes relatively larger. The rising edge Tr2 of the second sustain pulse SUS2 shorter than the rising edge Tr1 of the first sustain pulse SUS1 cause relatively larger discharge intensity. Herein, the rising edges Tr1 and Tr2 mean time intervals going from an operation time of the energy recovering circuit shown in FIG. 3 until a turning-on time of the second switch S2.

Accordingly, the second sustain pulse SUS2 having a larger pulse width than the first sustain pulse SUS1 compensates for a resistance of the current path extending from the sustain driver into the sustain electrode line Z. Thus, a sustain discharge intensity between the scan electrode line Y and the sustain electrode line Z becomes equal. If the discharge intensity is equal, then a discharge becomes uniform to thereby improve a picture quality.

Referring to FIG. 7A and FIG. 7B, a width TP1 of the first sustain pulse SUS1 applied to the scan/sustain electrode line Y is larger than a width TP2 of the second sustain pulse SUS2 applied to the sustain electrode line Z.

As shown in FIG. 7A, a rising edge Tr1 of the first sustain pulse SUS1 is identical to a rising edge Tr2 of the second sustain pulse SUS2; a sustain interval Ts1 of the first sustain pulse SUS1 is longer than a sustain interval Ts2 of the second sustain pulse SUS2; and a falling edge Tf1 of the first sustain pulse SUS1 is identical to a falling edge Tf2 of the second sustain pulse SUS2.

As shown in FIG. 7B, a rising edge Tr1 of the first sustain pulse SUS1 is shorter than to a rising edge Tr2 of the second sustain pulse SUS2; a sustain interval Ts1 of the first sustain pulse SUS1 is longer than a sustain interval Ts2 of the second sustain pulse SUS2; and a falling edge Tf1 of the first sustain pulse SUS1 is identical to a falling edge Tf2 of the second sustain pulse SUS2. As a rising edge of the sustain pulse is smaller, a discharge intensity becomes relatively larger. The rising edge Tr1 of the first sustain pulse SUS1 shorter than the rising edge Tr2 of the second sustain pulse SUS2 cause relatively larger discharge intensity.

Accordingly, the first sustain pulse SUS1 having a larger pulse width than the second sustain pulse SUS2 compensates for a resistance of the current path extending from the scan driver into the scan electrode line Y. Thus, a sustain discharge intensity between the scan electrode line Y and the sustain electrode line Z becomes equal. If the discharge intensity is equal, then a discharge becomes uniform to thereby improve a picture quality.

As described above, the method of driving the plasma display panel according to the present invention differentiates rising edges and sustain intervals of the first and second sustain pulses, thereby allowing the widths of the first and second sustain pulses to be different from each other. In other words, a sustain pulse having a relatively larger pulse width is applied to the electrode line having a relatively larger resistance of the current path extending from the electrode line into the driver. Accordingly, the sustain discharge intensity between the scan electrode and the sustain electrode is equal, so that it becomes possible to prevent an excessive discharge and hence improve a driving voltage margin.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display comprising:

applying at least one first sustain pulse to at least one first row electrode in a middle of a sustain period; and applying at least one second sustain pulse to at least one second row electrode during the sustain period, and the at least one second sustain pulse being applied subsequent to the at least one first sustain pulse, wherein a rising time of the at least one first sustain pulse or the at least one second sustain pulse is different from a falling time of the at least one first sustain pulse or the at least one second sustain pulse, respectively, wherein a width of the at least one first sustain pulse is different from a width of the at least one second sustain pulse, the sustain period is included in at least one subfield, and widths of the at least one first sustain pulse and the at least one second sustain pulse are based on a resistance between a first driver and the at least one first row electrode and a resistance between a second driver and the at least one second row electrode.

2. The method of claim 1, wherein the rising time is longer than the falling time.

3. The method of claim 1, wherein the width of the at least one second sustain pulse is shorter or longer than the width of the at least one first sustain pulse.

4. The method of claim 1, wherein the at least one first sustain pulse is repeatedly applied to the at least one first row electrode such that the at least one first sustain pulse comprises a plurality of first sustain pulses.

5. The method of claim 4, wherein the at least one second sustain pulse is repeatedly applied to the at least one second row electrode such that the at least one second sustain pulse comprises a plurality of second sustain pulses, and the first sustain pulse and the second sustain pulse are alternately applied to the at least one first row electrode and the at least one second row electrode, respectively.

6. The method of claim 1, wherein the rising time comprises a time period for the at least one first sustain pulse or the at least one second sustain pulse to change from a first potential level to a second potential level.

7. The method of claim 6, wherein the second potential level has a higher magnitude than the first potential level.

8. The method of claim 6, wherein the falling time comprises a time period for the at least one first sustain pulse or the at least one second sustain pulse to change from a third potential level to a fourth potential level.

9. The method of claim 8, wherein the third potential level has a higher magnitude than the fourth potential level.

10. The method of claim 1, wherein the width of the at least one first sustain pulse or the width of the at least one second sustain pulse comprises the rising time, the falling time, and a prescribed period of time between the rising time and the falling time.

11. The method of claim 10, wherein the prescribed period of the at least one first sustain pulse is longer or shorter than the prescribed period of the at least one second sustain pulse.

12. The method of claim 1, wherein at least one of the first sustain pulse or the second sustain pulse causes a sustain discharge during the sustain period.

13. The method of claim 1, wherein the at least one first row electrode comprises a plurality of scan electrodes arranged on a first substrate and the at least one second row electrode comprises a plurality of sustain electrodes arranged on the first substrate and parallel to the plurality of scan electrodes, a plurality of address electrodes formed on a second substrate and arranged to be perpendicular to the plurality of scan and sustain electrodes, a plurality of barrier ribs formed between the first and second substrates and a plurality of cells, wherein each cell is positioned at an intersection where each of the address electrodes intersect with corresponding scan and sustain electrodes.

14. A method of driving a plasma display comprising:

applying at least one first sustain pulse to at least one scan electrode in a middle of a sustain period; and applying at least one second sustain pulse to at least one sustain electrode and the at least one second sustain pulse being applied subsequent to the at least one first sustain pulse, wherein the rising time of the at least one second sustain pulse is different from the falling time of the at least one second sustain pulse, wherein a width of the at least one first sustain pulse is wider than a width of the at least one second sustain pulse, and a first prescribed time period for maintaining the at least one first sustain pulse near a first prescribed potential is longer than a second prescribed time period between the rising time and the falling time of the at least one second sustain pulse, and the sustain period is included in at least one subfield, and widths of the at least one first sustain pulse and the at least one second sustain pulse are based on a resistance between a first driver and the at least one scan electrode and a resistance between a second driver and the at least one sustain electrode.

15. The method of claim 14, wherein the rising time is longer than the falling time.

16. The method of claim 14, wherein a magnitude of the first and second prescribed potentials are the same.

17. The method of claim 14, wherein the at least one first sustain pulse is repeatedly applied to the at least one first row electrode such that the at least one first sustain pulse comprises a plurality of first sustain pulses.

18. The method of claim 17, wherein the at least one second sustain pulse is repeatedly applied to the at least one second row electrode such that the at least one second sustain pulse comprises a plurality of second sustain pulses, and the first sustain pulse and the second sustain pulse are alternately applied to the at least one first row electrode and the at least one second row electrode, respectively.

19. The method of claim 14, wherein the rising time comprises a time period for the at least one second sustain pulse to change from a first potential level to a second potential level.

20. The method of claim 19, wherein the second potential level has a higher magnitude than the first potential level.

21. The method of claim 19, wherein the second prescribed time period comprises a time for maintaining the at least one second sustain pulse near a second prescribed potential.

22. The method of claim 21, wherein the second potential level corresponds to the second prescribed potential.

23. The method of claim 19, wherein the falling time comprises a time period for the at least one second sustain pulse to change from a third potential level to a fourth potential level.

24. The method of claim 23, wherein the third potential level has a higher magnitude than the fourth potential level.

25. The method of claim 23, wherein the second prescribed time period comprises a time for maintaining the at least one second sustain pulse near a second prescribed potential.

26. The method of claim 25, wherein the third potential level corresponds to the second prescribed potential.

27. The method of claim 14, wherein the width of the at least one second sustain pulse comprises the rising time, the falling time, and the second prescribed time period between the rising time and the falling time.

28. The method of claim 27, wherein a rising time of the at least one first sustain pulse is the same as a falling time of the at least one first sustain pulse.

29. The method of claim 27, wherein the width of the at least one first sustain pulse comprises a rising time, a falling time, and the first prescribed time period between the rising time and the falling time.

30. The method of claim 14, wherein at least one of the first sustain pulse or the second sustain pulse causes a sustain discharge during the sustain period.

31. The method of claim 14, wherein the at least one scan electrode comprises a plurality of scan electrodes arranged on a first substrate and the at least one sustain electrode comprises a plurality of sustain electrodes arranged on the first substrate and parallel to the plurality of scan electrodes, a plurality of address electrodes formed on a second substrate and arranged to be perpendicular to the plurality of scan and sustain electrodes, a plurality of barrier ribs formed between the first and second substrates and a plurality of cells, wherein each cell is positioned at an intersection where each of the address electrodes intersect with corresponding scan and sustain electrodes.

* * * * *